US006575885B1

(12) United States Patent
Weck et al.

(10) Patent No.: US 6,575,885 B1
(45) Date of Patent: Jun. 10, 2003

(54) INFLATABLE DEVICE AND METHOD FOR USING THE DEVICE

(75) Inventors: David S. Weck, New York, NY (US); James E. Cotter, Ashland, OH (US)

(73) Assignee: D.W. Fitness, LLC, Madison, NJ (US)

( * ) Notice: Subject to any disclaimer, the term of this patent is extended or adjusted under 35 U.S.C. 154(b) by 3 days.

(21) Appl. No.: 09/596,709

(22) Filed: Jun. 19, 2000

Related U.S. Application Data

(63) Continuation-in-part of application No. 09/411,997, filed on Oct. 4, 1999, now Pat. No. 6,422,983.

(51) Int. Cl.[7] ..... A63B 21/00
(52) U.S. Cl. ..... 482/147; 482/146; 482/148
(58) Field of Search ..... 297/452.41; 5/655.3, 5/654, 706; 482/23, 30, 31, 142, 130, 146, 147, 77, 148

(56) References Cited

U.S. PATENT DOCUMENTS

| | | | | |
|---|---|---|---|---|
| 2,991,589 A | * | 7/1961 | Ayala | |
| 3,024,021 A | | 3/1962 | Coplin et al. | |
| 3,627,314 A | | 12/1971 | Brown | |
| 3,716,229 A | | 2/1973 | Van Der Cleyen et al. | |
| 4,159,826 A | | 7/1979 | Hancock | |
| 4,263,682 A | * | 4/1981 | Bejarano | |
| 4,516,767 A | | 5/1985 | Eskijian | |
| 4,516,768 A | | 5/1985 | Gallaro | |
| 4,801,140 A | * | 1/1989 | Bergeron | 482/148 |
| 4,893,229 A | | 1/1990 | Blankenzee | |
| 5,048,823 A | | 9/1991 | Bean | |
| D361,604 S | | 8/1995 | Stroppiana | |
| 5,549,536 A | | 8/1996 | Clark | |
| 5,643,154 A | | 7/1997 | Awbrey et al. | |
| 5,643,165 A | | 7/1997 | Klekamp | |
| 5,810,703 A | | 9/1998 | Stack | |

FOREIGN PATENT DOCUMENTS

| | | |
|---|---|---|
| DE | 20 32 544 A | 1/1972 |
| DE | 31 50 189 A | 7/1983 |
| DE | 36 20 706 A | 12/1987 |
| EP | 0 134 047 A | 3/1985 |

OTHER PUBLICATIONS

Duradisk Wobble Board, etc., www.paulchekseminars.com.
Exercise Balls; Gymnic Line, etc., www.balldynamics.com.
Dyna–Disc Pillow, etc., Perform Better.
Disc'O'Sit Air Cushion, etc., www.balldynamics.com.
Duradisk, etc., www.paulchekseminars.com.
Sit Fit, www.rpsportsinc.com/balance.htm.
K.A.T. 2000, www.oemmedical.com (2 pp.).
K.A.T. 500 product sheet.
Lower Extremity, Exercise Equipment (K.A.T. Products).
K.A.T. 550 product description.
Pogo Ball Drawing.

* cited by examiner

*Primary Examiner*—Jerome W. Donnelly
(74) *Attorney, Agent, or Firm*—Lerner, David, Littenberg, Krumholz & Mentlik, LLP

(57) ABSTRACT

An inflatable device can be used for physical therapy, conditioning or training. The device has a support platform and a flexible member. The flexible member is attached or affixed to, and has a bowl-shaped distention projecting from one side of, the platform. This flexible member is inflatable to a pressure for supporting a person. The device is inflated in order to support at least some of the weight of a person by compressing the inflatable device at or adjacent to its center. When the person wishes to later change the characteristics of the device, the pressure in the inflatable device can be changed to change its stability.

31 Claims, 13 Drawing Sheets

FIG. 20
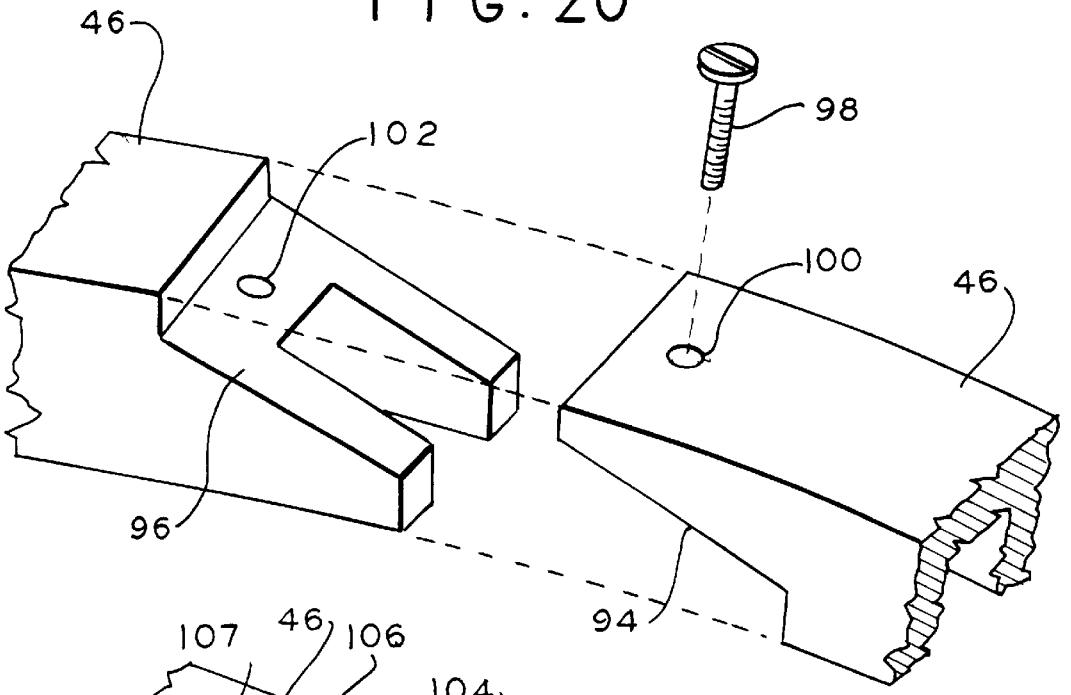
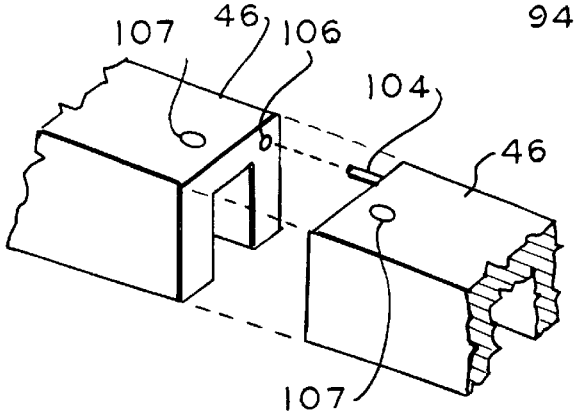
FIG. 21
FIG. 18
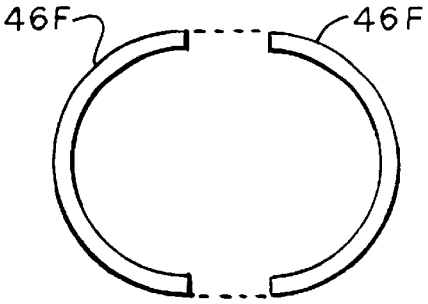
FIG. 19
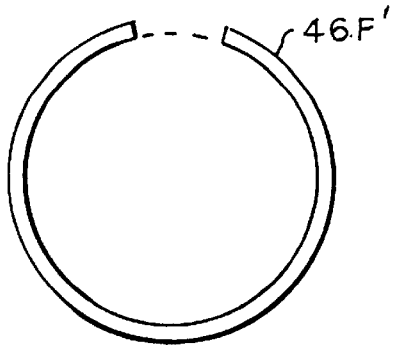

INFLATABLE DEVICE AND METHOD FOR USING THE DEVICE

This application is a continuation-in-part of application Ser. No. 09/411,997, filed Oct. 4, 1999, now U.S. Pat. No. 6,422,983.

BACKGROUND OF THE INVENTION

1. Field of the Invention

The present invention relates to devices for physical therapy, conditioning or training, and in particular to inflatable devices.

2. Description of Related Art

Many devices are known for facilitating exercises done for therapy, conditioning or physical training. Other than variable resistance training equipment, these devices have not usually offered much adjustability to allow for exercises at different degrees of difficulty. Also, many of these devices have been dedicated to very specific exercises and therefore do not justify a significant investment of space and financial resources for such a narrow purpose.

Some exercise devices require a person to maintain balance and equilibrium. A large inflatable ball (for example, 65 cm), known as a Swiss ball, has been used for this purpose. While the ball is useful for certain stability training exercises, standing upon the ball or staying atop the ball requires a high degree of skill and is inappropriate for most.

In U.S. Pat. No. 4,801,140 a person suffering from a physical disability can stand on the flat side of a non-inflatable molded foam hemisphere to practice balancing. The practical disadvantage of this design is that a high degree of skill is required before someone can actually stand on such an unstable platform. Without assistance from a therapist or additional balancing accessories, this platform is accessible only to trained athletes.

In U.S. Pat. No. 5,810,703 the underside of a small board is fitted with a smaller spherical projection. The relatively small diameter of the spherical projection tends to make the board relatively unstable. The height of the spherical projection can be set to one of three discrete settings. Overall, the adjustment has little range and resolution. Also, the projection, if inverted to face upwardly, is too small to allow a person to perform an exercise while placing weight on the projection.

An inflated cushion in the shape of a disk (sold under the name DuraDisk through C.H.E.K. Institute) has been described as useful for certain exercises. This cushion is described as needing no inflation, but the product is shipped with an inflation valve that the user has access to. A separate wooden platform, 20 inches in diameter, is sold for the purpose of placing the platform over the cushion to create a balance board. This cushion is relatively flat and therefore offers little challenge to a user. It is not useful for the inflatable disk to be placed on the board as this would offer no advantage over putting the inflatable disk on the floor. Also, the use of a separate platform requires careful placement and centering of the platform and also introduces the need for regularly finding and associating the separate parts.

In U.S. Pat. No. 5,643,154 a relatively squat, rounded ballast is mounted under a relatively wide platform. If the user is willing to stock an inventory, the rounded ballast can be changed, but the individual ballasts are not adjustable. This device is designed for use on land or in water. For use in water, an edge bumper is inflated an adjustable amount to reach the desired buoyancy. While this edge bumper is adjustable, this adjustment is only effective in water. The stability of the platform on land will not be substantially affected by adjusting an edge bumper, which inherently provides a stable base. See also U.S. Pat. No. 3,024,021 for a non-adjustable device employing a platform connected through a resilient member to a rounded base.

U.S. Pat. No. 5,643,165 shows a frustroconical balancing device with a flattened apex. This device is stable in only one central position, and becomes highly unstable once tilted slightly. Furthermore, the stability of this device is not adjustable. See also U.S. Pat. No. 5,549,536 for a continually tilted platform.

Accordingly, there is a need for an improved device that offers a unique experience and range of possible exercises, and that can allow adjustment, preferably with an inflatable device, to accommodate persons with different levels of skills and capabilities.

SUMMARY OF THE INVENTION

In accordance with the illustrative embodiments demonstrating features and advantages of the present invention, there is provided a device for physical therapy, conditioning or training. The device has a support platform and a flexible member. The flexible member is attached to, and has a bowl-shaped distention projecting from one side of, the platform. This flexible member is inflatable to a pressure for supporting a person.

In accordance with another aspect of the invention there is provided, a method for physical therapy, conditioning or training. The method employs an inflatable device having a flexible member distending from a platform. The method includes the step of inflating the inflatable device to form a domed surface adjacent a relatively flat surface. Another step is placing at least some of the weight of a person on said inflatable device. The method also includes the steps of removing the weight of the person and changing the pressure in the inflatable device to change its stability. Another step is again placing at least some of the weight of a person on said inflatable device.

By employing devices and methods of the foregoing type, a variety of exercises can be performed by persons of varying levels of skills and capabilities. In a preferred embodiment a flexible, sheet-like member is affixed along the edge of a rigid circular platform, although other non-circular outlines are contemplated. This preferred, sheet-like member can be inflated by a valve installed, for example, in the center of the platform. When inflated, the flexible, sheet-like member forms a domed or hemispherical surface, at least before being loaded.

In some embodiments the flexible member may be a closed volume bounded by a first and second surface. The first surface can be laid on a flat circular platform and clamped to the edge of the platform with an annular bead to keep the first surface flat after inflation. Since the second surface is mostly free, it forms a curved surface that is approximately hemispherical.

In some embodiments a circular panel can be attached to the underside of the platform to sandwich between them an edge of the flexible, sheet-like member. The edge of the platform may have an upwardly extending lip formed by either rolling the edge of the platform, or by attaching a bead to the platform's edge. In some embodiments the edge of the flexible, sheet-like member can be sandwiched between the bead and the platform.

In some cases the user may place the flexible, sheet-like member on the ground and then stand on the platform to enhance the user's balance. The stability of the platform can be altered by adjusting the pressure behind the flexible, sheet-like member. In other cases the user may place the platform on the ground and then stand on the inflated flexible, sheet-like member. This orientation may facilitate balance exercises, to enhance proprioceptive awareness and core stability. Numerous other exercises can be performed when the person uses the flexible, sheet-like member for sitting or supporting a hand, foot, extremity, etc., while performing situps, squats, lunges, etc.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 18 is a plan view of the bead of FIGS. 8 and 12;

FIG. 19 is a plan view of a bead that is an alternate to that of FIG. 18;

FIG. 20 is a detailed axonometric view of the ends of the beads of FIG. 18;

FIG. 21 is a detailed, axonometric view of the ends of beads that are an alternate to that of FIG. 20;

DETAILED DESCRIPTION OF THE PREFERRED EMBODIMENTS

Figure 1:
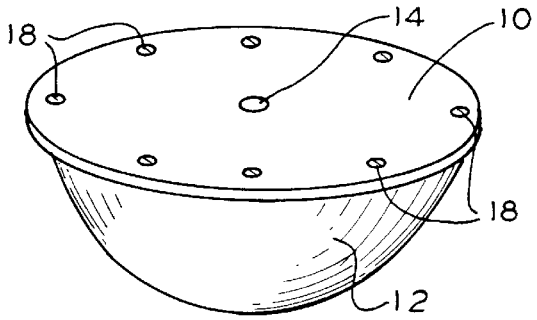
FIG. 1 is an axonometric view of a device in accordance with principles of the present invention.
Figure 2:
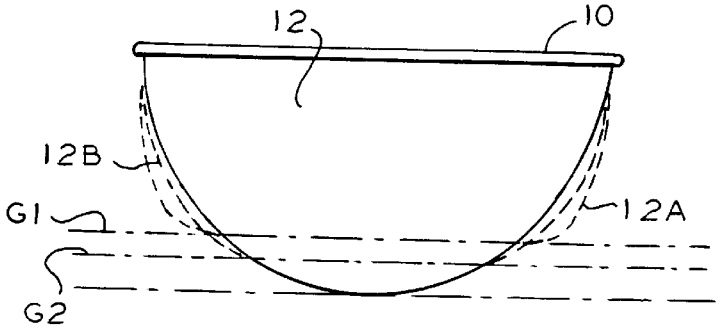
FIG. 2 is a side elevational view of the device of FIG. 1, showing various levels of distension.

Referring to FIGS. 1 and 2, the illustrated device has a support platform 10 with a circular outline, although other outlines are contemplated (elliptical, polygonal, etc.). Platform 10 can be made of wood, plastic, metal, or other materials. A flexible, sheet-like member in the form of an elastomeric sheet 12 is shown secured to the edge of platform 10. The edge of sheet-like member 12 is attached with an airtight seal to platform 10 by glueing, by clamps, or by other sealing means. Sheet-like member 12 can be made of any one of a variety of materials, including natural and synthetic rubbers, plastics, etc. Also, in some embodiments sheet-like member 12 may be a laminate having an outer surface that is more durable and skid resistant.

Sheet-like member 12 may be formed by rotational molding or otherwise to have a natural hemispherical shape. This hemispherical shape preferably has a diameter of 16 to 36 inches (41 to 91 cm), although other dimensions are contemplated. It will be appreciated, however, that under normal use, and when loaded, the sheet-like member 12 will have a profile that is more complex than a hemisphere. In other embodiments, sheet-like member 12 may start as a flat circular sheet that distends when inflated into a dome (taking essentially a hemispherical shape when unloaded).

A valve means 14 is mounted in a center hole in platform 10. The valve means 14 may be a rubber bushing covered on its inside with a flexible flap that acts as a check valve. Valves of this type are used to inflate basketballs, footballs, etc. If the device need only be inflated to a relatively low pressure, a tube with a stopper can permit a user to blow into the tube to inflate the device, as is done with inflatable beach balls, and the like. Various other types of valves can be used in different embodiments, depending upon the desired pressure, pumping method, etc. Also, valve 14 can be located on alternate positions on platform 10, or on various positions on sheet-like member 12.

Figure 3:
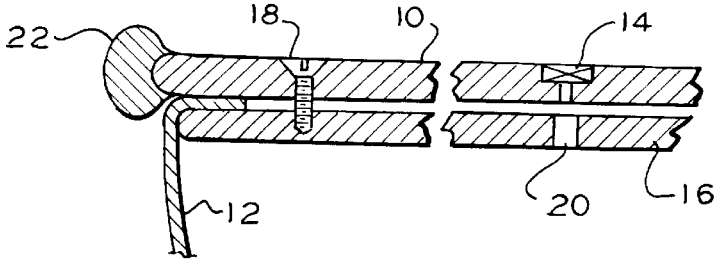
FIG. 3 is a detailed, fragmentary, cross-sectional view of the device of FIG. 1, but modified to include an additional bead.

Referring to FIGS. 1 and 3, a circular deck 16 is shown as an element attached to the underside of platform 10 by means of screws 18, although other types of fasteners may be used instead. The edge of sheet-like member 12 is shown sandwiched between platform 10 and underlying deck 16. The seal at the edge of sheet-like member 12 can be enhanced by using an appropriate glue, caulk, gasket compound, or other sealing material. The hole holding valve means 14 is aligned with hole 20 in underlying deck 16, although such alignment is unnecessary, and in some embodiments a number of spaced holes may be used instead. Platform 10 and deck 16 may be made of different materials, so that the outer surface may be flexible and skid proof, while the inside deck may be rigid and able to bear heavy loads. In still other embodiments, underlying deck 16 may be replaced with a hoop or other annular structure to simply concentrate on its function of acting as an affixing means for sealing sheet-like member 12 to platform 10.

The edge of platform 10 is fitted with an annular bead 22. Bead 22 may be secured by glueing or by various fasteners. Also, bead 22 may have a variety of shapes. Bead 22 can be formed of a length of extruded rubber or plastic that is closed into a loop. Alternatively, bead 22 may be initially molded as an annulus. Preferably, the top of bead 22 rises above the surface of platform 10 to provide a small guard. Also in preferred embodiments, bead 22 may be relatively soft material that prevents injury caused by the user accidentally kicking or otherwise colliding with the edge of platform 10.

Figure 25:
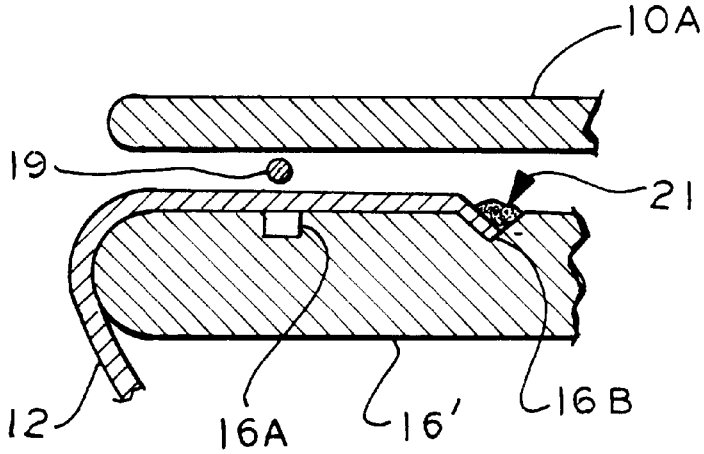
FIG. 25 is a detailed, fragmentary, cross-sectional view of a constructed device that is an alternate to that of FIG. 3.

Referring to FIG. 25, alternate platform 10A is similar to the previously described platform of FIG. 3 and may be secured to the deck 16' with screws or other fasteners (not shown). Deck 16' is similar to the previously illustrated deck, but has a rectangular annular groove 16A to the outside of, and concentric with, an annular, V-shaped groove or furrow 16B. In this constructed embodiment, the edge of flexible member 12 was glued and stapled in the illustrated position. A bead 21 of cement is shown in furrow 16B along the edge of flexible member 12.

A spline 19 is shown positioned between flexible member 12 and platform 10A, in alignment with rectangular groove 16A. Spline 19 may be similar to the plastic cords used to secure screens into rectangular grooves in frames, although other material can be used instead. Essentially, platform 10A is secured to deck 16' so that spline 19 presses flexible member 12 into groove 16A to form a relatively tight seal. As before, platform 10A may have a valve (not shown) for inflating flexible member 12.

Figure 4:
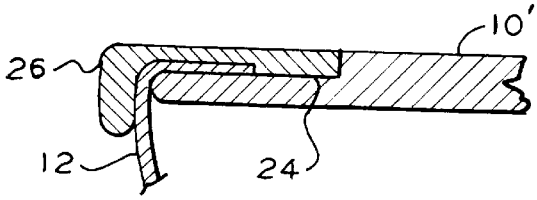
FIG. 4 is a detailed, fragmentary, cross-sectional view of a device that is an alternate to that of FIG. 2.

Referring to FIG. 4, alternate platform 10" is similar to the previously described platform, but with a peripheral recess 24. An annular bead 26 is shown fitted in recess 24, while sandwiched between them is previously mentioned sheet-like member 12. As before, bead 26 may be a molded annulus or may be formed from a length of extruded material that is closed into a loop. Alternatively, the edge of sheet-like member 12 may be sealed into recess 24 before molding bead 26 in situ. Bead 26 has an outside surface that is coplanar with the outside surface of platform 10" to facilitate situations where the device is placed with platform 10" down, for certain exercises to be described presently.

Figure 5:
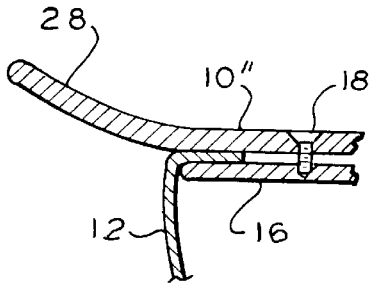
FIG. 5 is a detailed, fragmentary, cross-sectional view of a device that is an alternate to that of FIG. 2.

Referring to FIG. 5, previously mentioned deck 16 is shown attached by means of screws 18 to alternate platform 10". Also as before, sheet-like member 12 is sandwiched between elements 10" and 16. Platform 10" has an integral edge 28 that is rolled. Platform 10" maybe shaped by molding, stamping, bending, etc.

Figure 6:
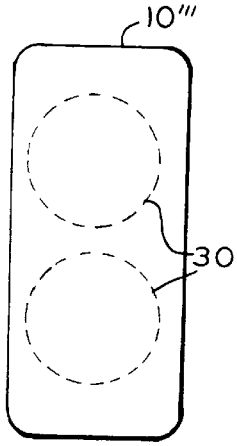
FIG. 6 is a plan view of a device that is an alternate to that of FIG. 1.

Referring to FIG. 6, an alternate platform 10'" is generally rectangular with rounded corners. Platform 10'" to be dimensioned to simulate the general size and feel of a skate board or snowboard. Here, two inflatable domes 30 are sealed to the underside of platform 10'" using structure and techniques similar to that previously described. The domes 30 are arranged so that the platform 10'" can roll (rotation about a longitudinal axis) fairly easily, but cannot pitch unless the user places significant weight at the front or back of the platform 10'".

Figure 8:
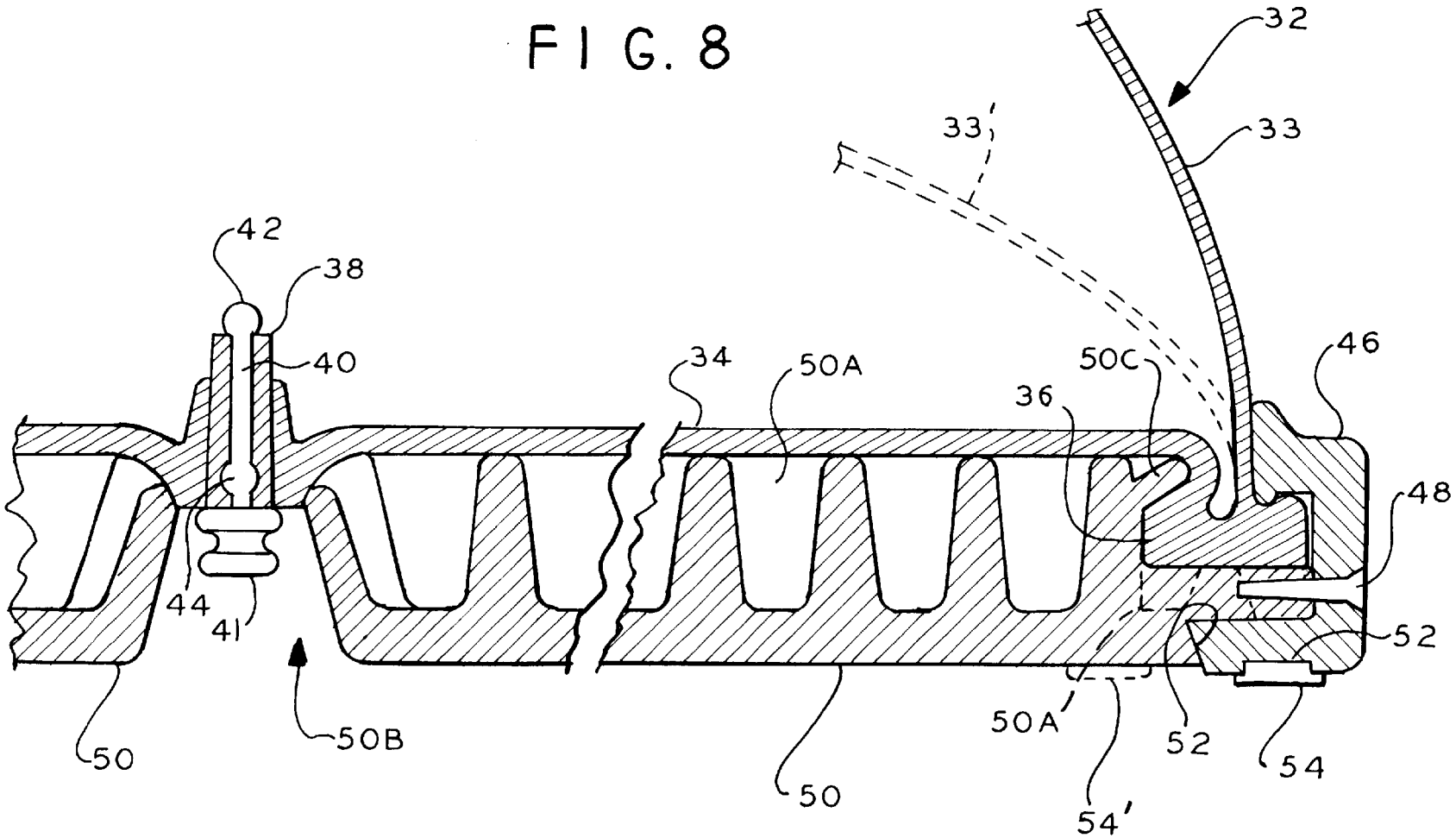
FIG. 8 is a cross-sectional view of a device that is an alternate to that of FIG. 1.

Referring to FIG. 8, the previously mentioned flexible member is shown here as an axially symmetric member 32 in the form of a closed volume having a domed portion 33 integral with a floor portion 34. Domed portion 33 and floor portion 34 merge at a foot 36. Flexible member 32 may be formed by rotational molding, although other fabrication techniques are possible, such as welding together two flexible sheets at a foot area. Domed portion 32 will be approximately hemispherical while floor portion 34 will be a substantially flat, circular disk.

A plastics sleeve 38 is fitted in an opening in the center of floor portion 34. A plug 40 is shown inside sleeve 38 and has a handle 41 with a pulley-like shape. Plug 40 has a bulbous inside end 42 and a bulbous portion 44 that keeps plug 40 in approximately the position illustrated. Plug 40 can be removed to deflate flexible member 32 or to inflate it by inserting inside sleeve 38 a tubular fitting connected to a pump or other pressure source.

Figure 14A:
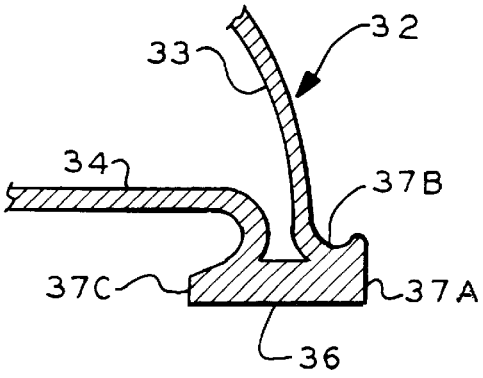
FIGS. 14A through 14J are detailed, cross-sectional views of the foot of flexible, sheet-like members that may be mounted on platforms of the type shown in FIG. 8, wherein FIG. 14A corresponds to the foot shown in FIG. 8.

Foot 36 is also illustrated in FIG. 14A in a relaxed, uncompressed state. Foot 36 has a toe 37A projecting radially outward and is molded with an annular valley 37B. Foot 36 also has a heel 37C projecting radially inward.

Figure 15A:
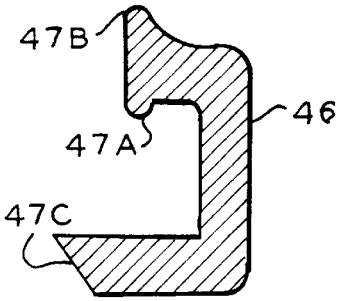
FIGS. 15A through 15K are cross-sectional views of beads that may be used to secure the flexible, sheet-like members of FIGS. 8, and 14A–14J.

An annular bead 46 with a C-shaped cross-section is attached by screws 48 to the edge of platform 50. Bead 46 is also shown in FIG. 15A and has on one of its branches a downwardly projecting, annular nub 47A designed to engage the valley 37B of foot 36 (FIG. 14A). Bead 46 has a sculpted annular ridge 47B to provide a smooth transition from the bead 46 to the flexible member 32. Bead 46 also has on its other branch a graded or beveled end 47C shaped to fit in a matching undercut channel 52 in platform 50, which holds bead 46 in place to provide additional attachment strength.

Figure 9:
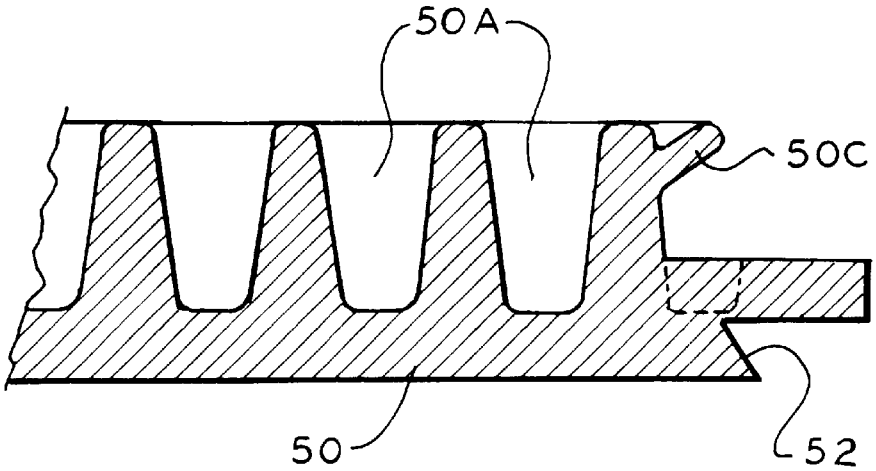
FIG. 9 is a detailed, cross-sectional view of the platform of FIG. 8.

Platform 50 (shown also in FIG. 9) is preferably a thermoplastic material molded into a honeycomb structure having a plurality of cells 50A. Platform 50 has a center opening 50B for plug 40. Platform 50 also has an annular flange 50C for holding the heel of foot 36.

Figure 11:
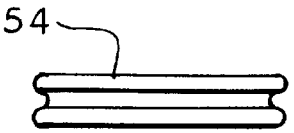
FIG. 11 is an edge view of the foot of FIG. 10.
Figure 10:
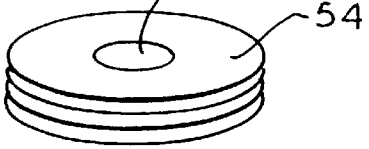
FIG. 10 is an axonometric view of the elastomeric foot in FIG. 8.

An elastomeric pad 54 on the underside of bead 46 is installed in a cavity that is essentially cylindrical, although some embodiments may have undercut side walls for holding pad 54. FIGS. 10 and 11 show pad 54 having an annular, pulley-like shape. Concentric hole 56 enables pad 54 to more easily compress and fit into a cavity. In some embodiments, pad 54 will be mounted directly in platform 50 instead, as shown in phantom as alternate pad 54'.

Figure 24:
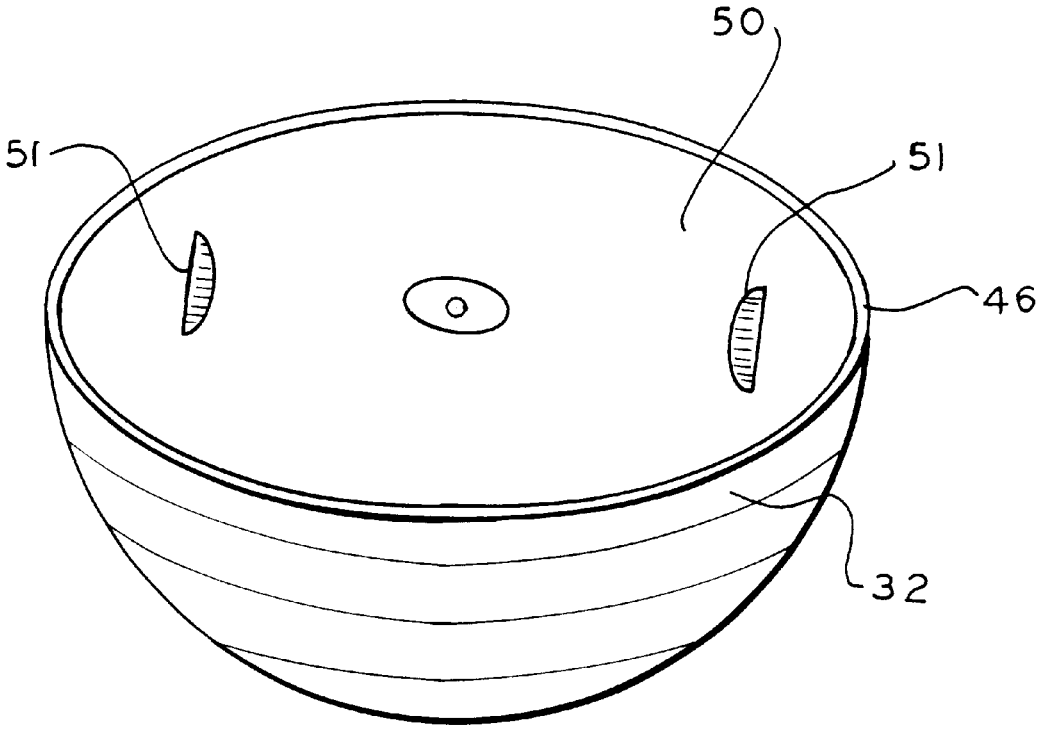
FIG. 24 is an axonometric view of the device of FIG. 1 modified to include handholds.

Referring to FIG. 24, previously mentioned flexible member 32 is shown installed on platform 50 with bead 46. Platform 50 is shown on its underside with a pair of cavities 51, acting as handholds. Preferably, cavities 51 are undercut so that the user can wrap his or her fingers around the undercut, in order to carry the device.

Figure 12:
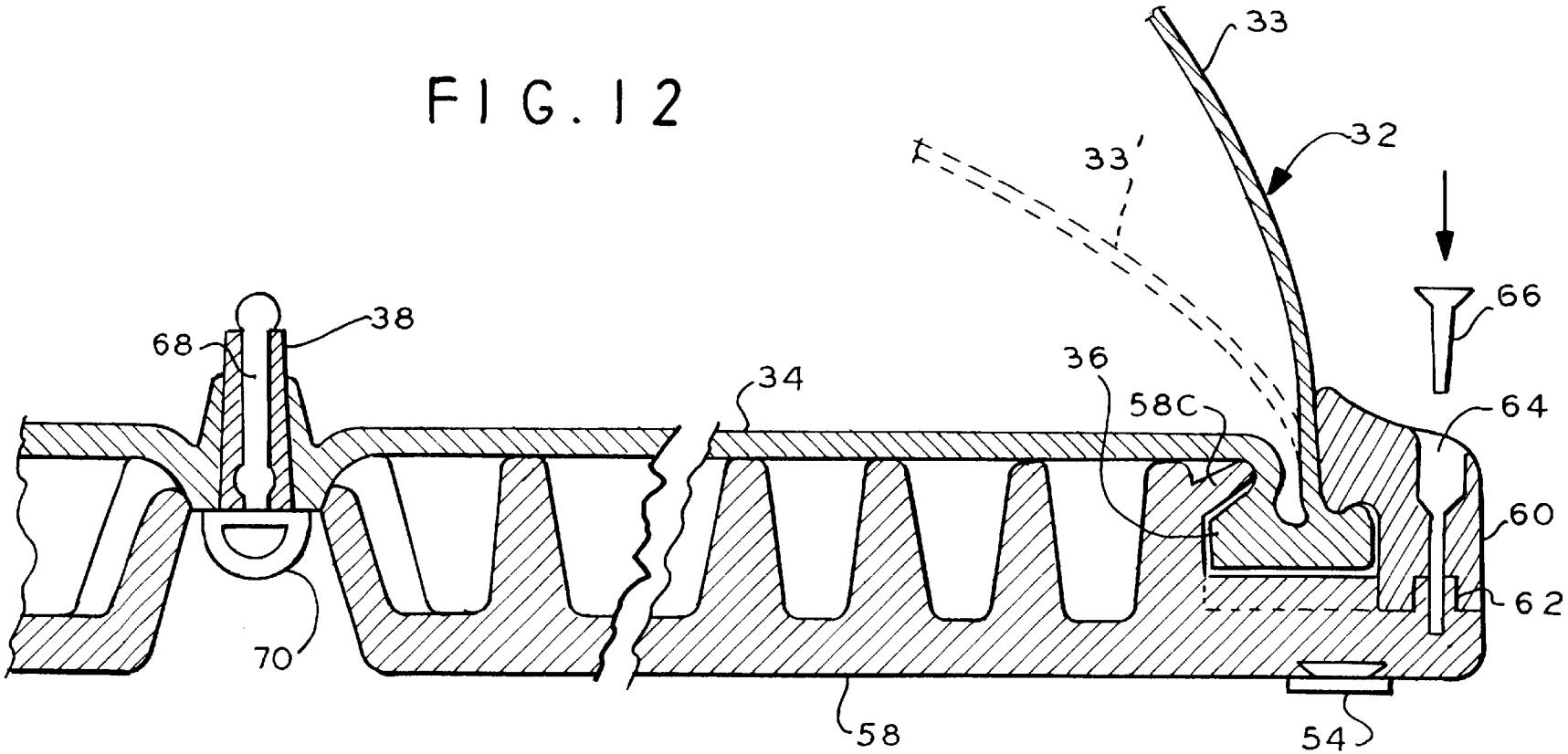
FIG. 12 is a cross-sectional view of another device that is an alternate to that of FIG. 1.

Referring to FIG. 12, previously mentioned flexible member 32 is shown installed on alternate platform 58. Platform 58 is fitted with a number of pads 54, in a manner described previously in connection with FIG. 8. Platform 58 has an annular flange 58C shaped the same as previously described flange 50C of FIG. 8. Platform 58 is designed to support a hook-shaped (in this view, inverted J-shaped), annular bead 60 in place of the previously described C-shaped bead. Bead 60 has an annular groove designed to fit over and form a tongue and groove joint with the annular ridge 62, which projects upwardly along the perimeter of platform 58. Bead 60 has a number of countersunk holes 64 to allow bead 60 to be attached to platform 58 by means of a number of screws 66.

The illustrated, alternate plug 68 is the same as previously mentioned plug 40 (FIG. 8), except for having an annular handle 70.

Figure 16A:
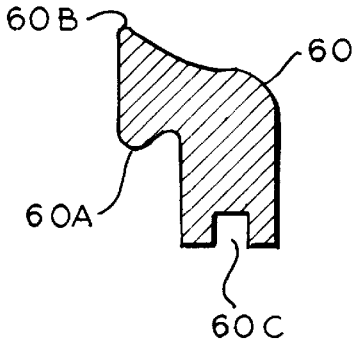
FIGS. 16A through 16F are cross-sectional views of beads that may be used to secure the flexible, sheet-like members of FIGS. 12, and 14A–14J.

Referring to FIGS. 12, 14A and 16A, previously described bead 60 is shown with previously mentioned annular groove 60C. Bead 60 has a downwardly projecting, annular nub 60A designed to engage the valley 37B of foot 36 (FIG. 14A). Bead 60 has a sculpted annular ridge 60B to provide a smooth transition from the bead 60 to the flexible member 32.

Figure 14B:
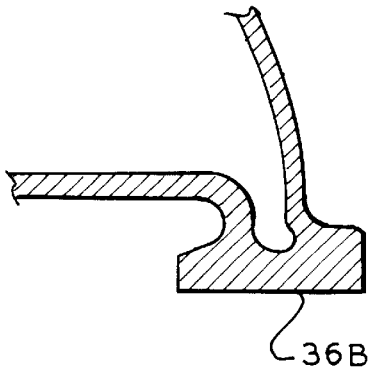

FIG. 14B shows a foot 36B that is an alternate to that of FIG. 14A. These two feet are essentially the same except that foot 36B does not have the valley 37B shown in FIG. 14A. Therefore, a matching platform will not need a nub designed to fit in a valley. The feet 36G and 36H are functionally equivalent to the foot 36B of FIG. 14B but are proportioned somewhat differently.

Figure 14C:
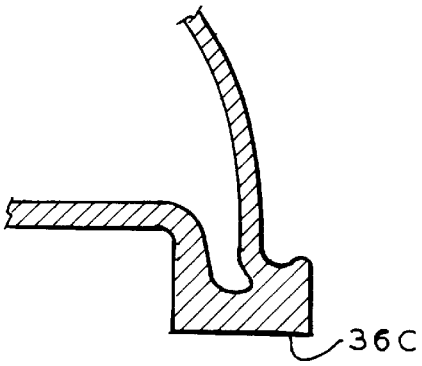
Figure 14D:
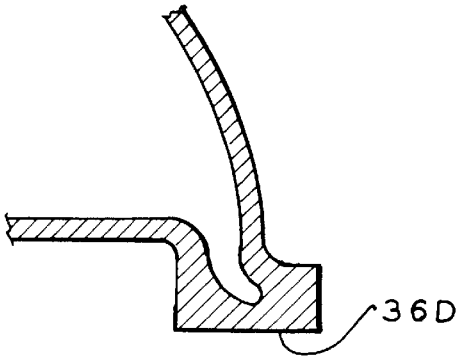

Foot 36C of FIG. 14C is the same as foot 36 of FIG. 14A, except that heel 37C is eliminated. Foot 36D is the same as foot 36B of FIG. 14B, except that the heel is eliminated. Therefore, in both cases, a matching platform will not need a flange to entrap a heel.

Figure 14E:
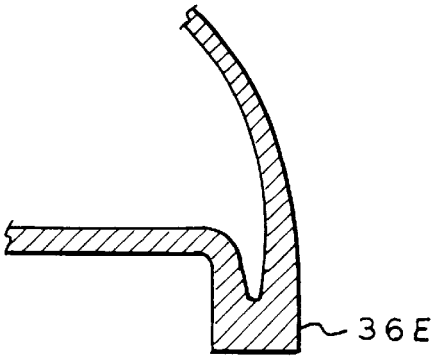
Figure 14F:
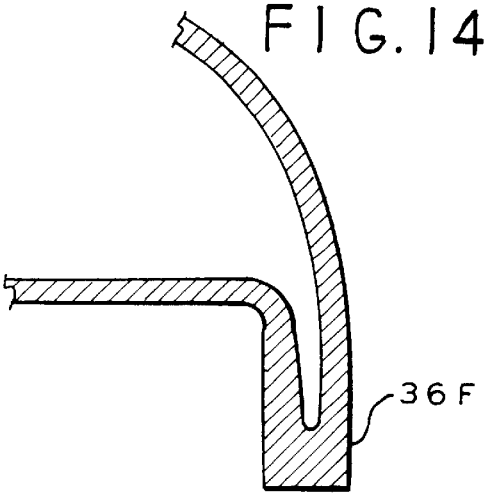
Figure 14G:
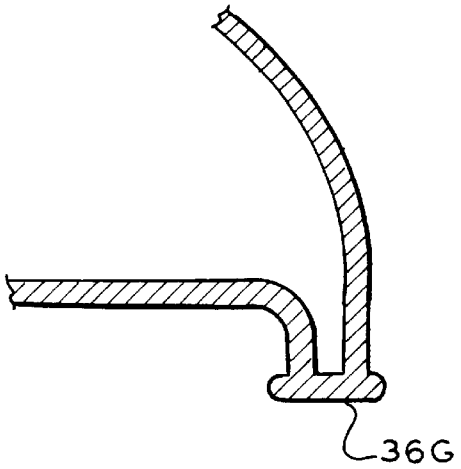
Figure 14H:
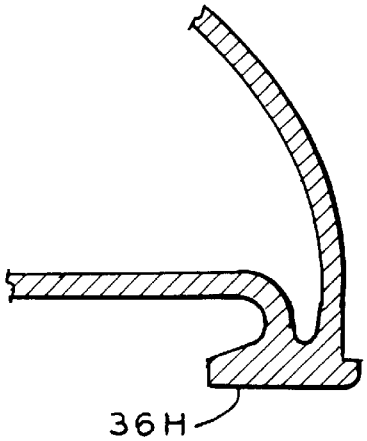

Referring to FIGS. 14E and 14F, the feet 36E and 36F are simple annular ridges without the previously described toes and heels of, for example, foot 36 of FIG. 14A. These feet may be simply wrapped around the edge of a platform and clamped in place using techniques such as those shown in FIGS. 3, 4, and 5.

Figure 13:
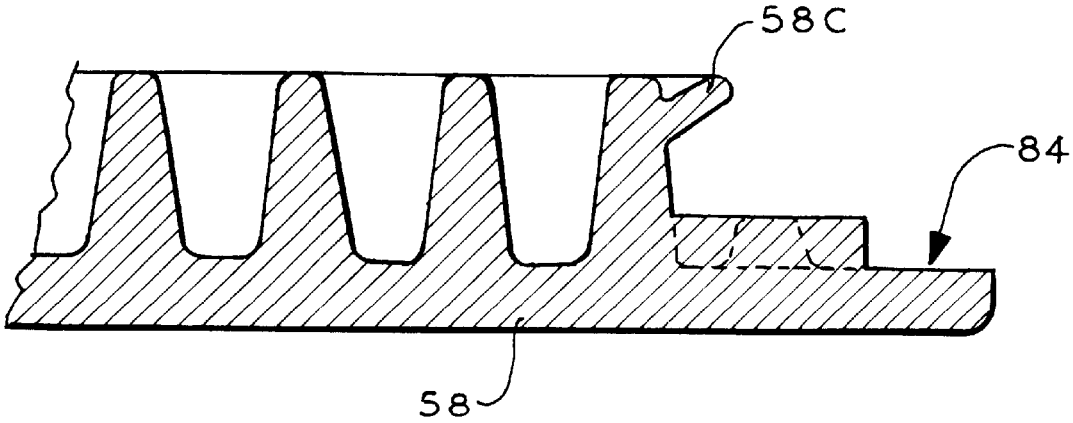
FIG. 13 is a detailed, cross-sectional view of the platform of FIG. 12.
Figure 14I:
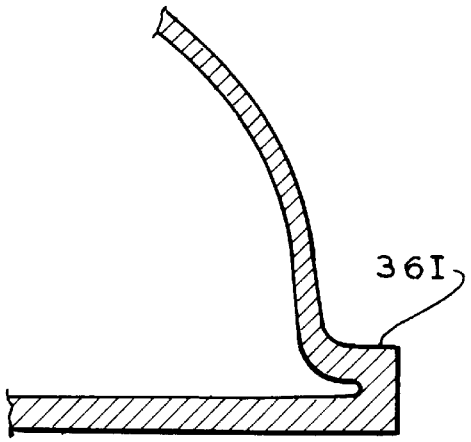

Referring to FIG. 14I, a foot 36I does not project downwardly, but operates more like a simple flange. Foot 361 would be attached to a platform having a flat surface, that is, a platform without the peripheral notches shown in the embodiments of FIGS. 9 and 13. Foot 36I would be clamped to a platform by a C-shaped bead if such as those shown in FIGS. 15A–K. These beads would embrace foot 36I and the platform.

Figure 14J:
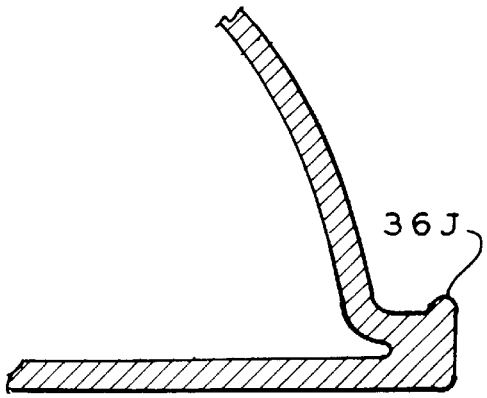

Referring to FIG. 14J, foot 36J is similar to that previously described in FIG. 14I, except that foot 36J has an upwardly and downwardly directed ridge. The upwardly directed ridge can be contained in a groove in a C-shaped bead, while the downwardly directed ridge can be contained in a groove in the bead or the platform.

Figure 15B:
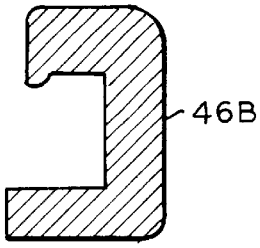
Figure 15C:
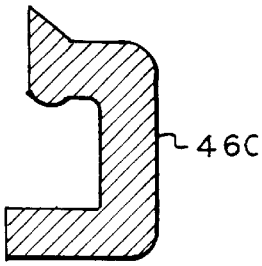

Referring to FIG. 15C, bead 46C has its lower end squared and eliminates the beveling of end 47C of FIG. 15A. Therefore a matching platform will not need the previously mentioned undercut and will simply have a butt joint. Bead 46B of FIG. 15B is the same as bead 46C, except that the transition feature 47B of FIG. 15A was eliminated.

Figure 15D:
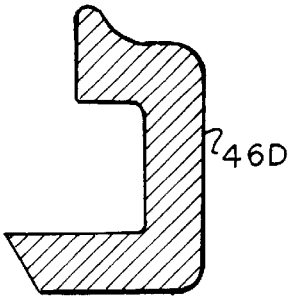
Figure 15E:
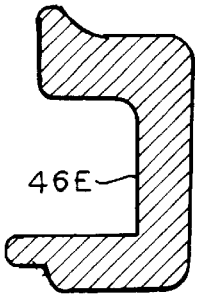
Figure 15F:
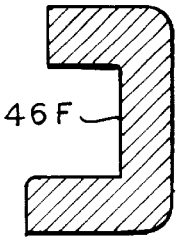

Bead 46 D of FIG. 15D is the same as bead 46 of FIG. 15A except that annular nub 47A was eliminated, so that the bead does not need a foot with a valley. Bead 46E of FIG. 15E is the same as bead 46D of FIG. 15D, except that the lower beveled end is replaced with a stepped profile, which will mate with a platform having a matching profile.

Figure 15G:
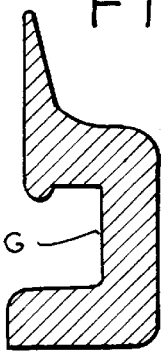
Figure 15H:
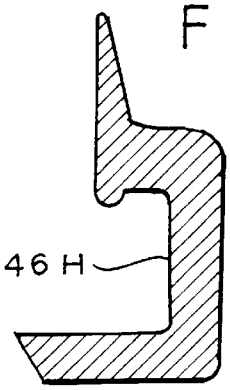

Bead 46H of FIG. 15H is similar to bead 46 of FIG. 15A except that feature 47B has been elongated. Bead 46G of FIG. 15G is the same as that of FIG. 15H except that the lower beveled end is replaced with the squared end as shown in FIG. 15C.

Figure 15I:
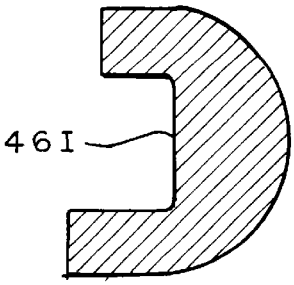
Figure 15J:
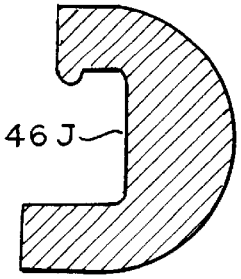
Figure 15K:
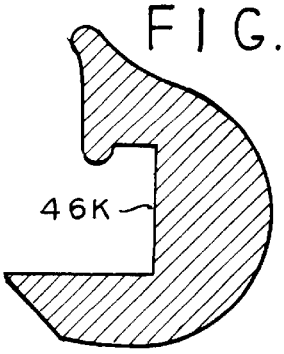

Referring to FIGS. 15I, 15J, and 15K, beads 46I, 46J, 46K correspond to previously mentioned beads 46F, 46B, and 46, respectively, except that their outside edges are rounded.

Figure 16B:
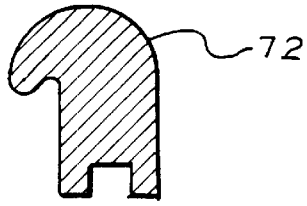

Referring to FIG. 16B, bead 72 is essentially the same as that of FIG. 16A, except that sculpted feature 60B was eliminated.

Figure 16D:
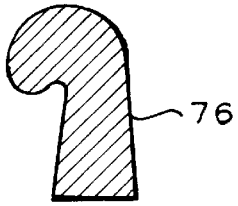
Figure 16C:
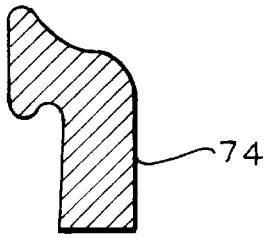

Referring to FIGS. 16C and 16D, beads 74 and 76 correspond to beads 60 and 72, respectively, of FIGS. 16A and 16B, except that they do not have the annular groove (for example, annular groove 60C of FIG. 16A). These beads will fit in the notch 84 of platform 82 of FIG. 13. Platform 82 is shown with an annular flange 86 designed to entrap feet having radially inward heels.

Figure 16E:
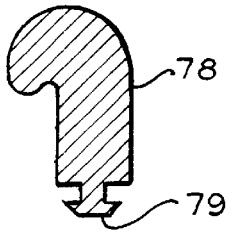

Referring to FIG. 16E, bead 78 is the same as that of FIG. 16D, except for snap fitting 79, which has an arrowhead-like cross-section designed to fit in an annular groove (not shown) on a platform. This groove preferably has undercut walls.

Figure 16F:
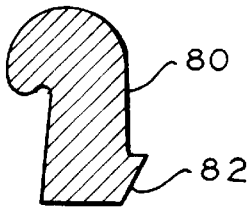

Referring to FIG. 16F, bead 80 is the same as that of FIG. 16E, except that bead 80 has a beveled wall 82 that allows bead 80 to fit into a matching groove (not shown) on a platform. The shape will allow bead 80 to snap into place.

Figure 17A:
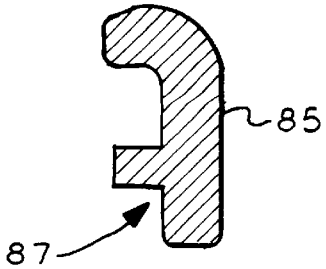
FIGS. 17A and 17B are cross-sectional views of beads that may be used to secure the flexible, sheet-like members of FIGS. 8, and 14A–14J.
Figure 17B:
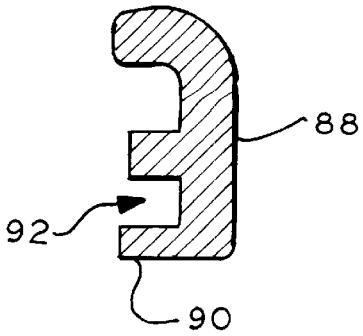

Referring to FIG. 17A, bead 85 has an F-shaped cross-section which provides a corner 87. Corner 87 may fit over a shelf, such shelf 84 of platform 58 of FIG. 13. Referring to FIG. 17B, bead 88 is similar to bead 85 of FIG. 17A, except for lower branch 90 which forms a groove 92 that can fit over the edge of a platform, such as platform 58 of FIG. 13.

Referring to FIG. 18, previously mentioned bead 46F (FIG. 15F) is shown formed from two semi circular halves. In other embodiments the bead may be a split ring, such as that shown in FIG. 19 as bead 46F'.

In any event, the ends of the bead's must be joined together. In FIG. 20, beads 46 are shown with beveled cuts 94 and 96 designed to form a circumferential lap joint. Once overlapped, the two ends can be joined together by threading screw 98 through hole 100 and hole 102 into the edge of a platform.

Referring to FIG. 21, the ends of previously mentioned beads 46 are squared off to form a circumferential butt joint. The beads can be aligned with pin 104 fitted in holes 106 in the ends of beads 46. Beads 46 can also be secured to a platform using screw holes 107.

Figure 22:
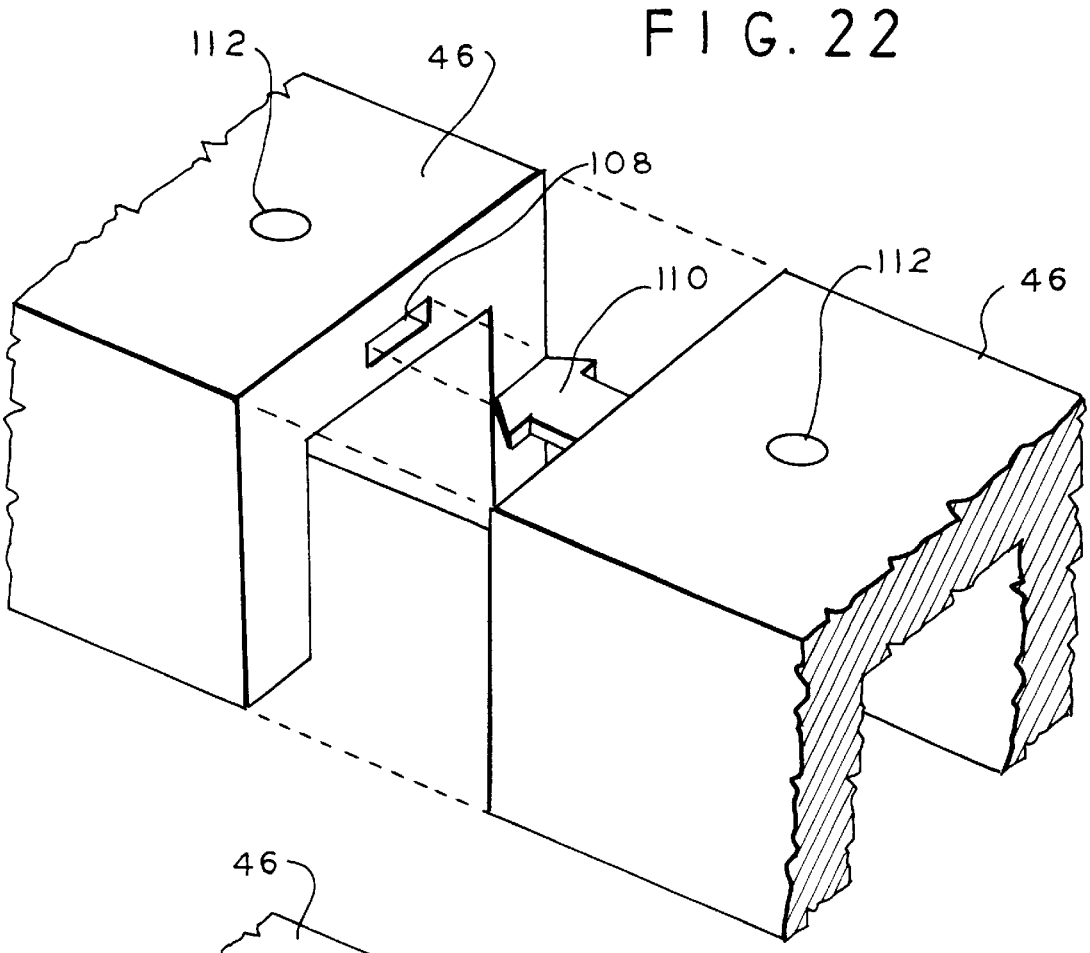
FIG. 22 is a detailed, axonometric view of the ends of beads that are an alternate to that of FIG. 20.

Referring to FIG. 22, previously mentioned beads 46 are again squared to form a butt joint. Here each of the ends of the beads 46 has a slot 108. A barb 110 having an arrowhead-like shape on either end locks into slots 108 to align beads 46 and lock them together. Beads 46 can also be secured to a platform using screw holes 112.

Figure 23:
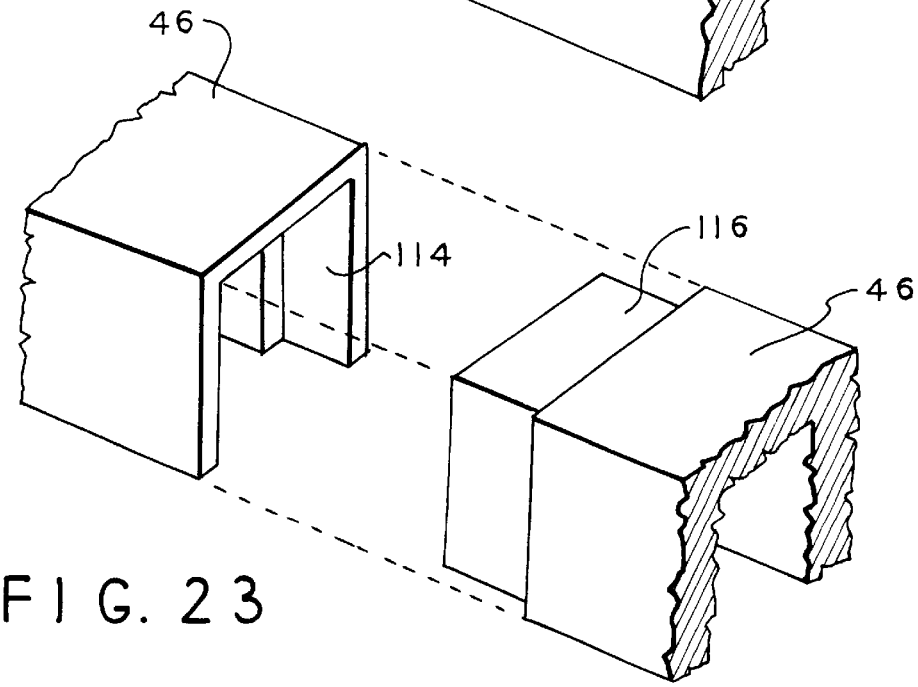
FIG. 23 is a detailed, axonometric view of the ends of beads that are an alternate to that of FIG. 20.

Referring to FIG. 23, beads 46 are relieved to form a telescopic joint. In particular, an internally relieved section 114 is designed to fit over externally relieved section 116. As before, beads 46 can be screwed into the edge of a platform.

Figure 26:
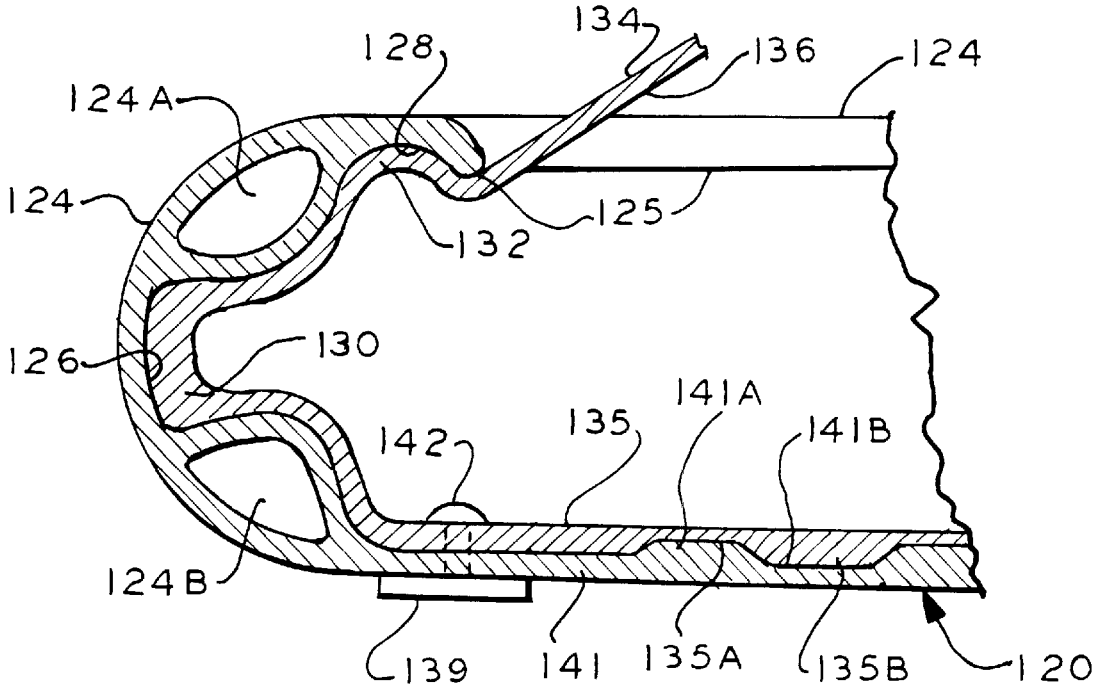
FIG. 26 is a cross-sectional view of a device that is an alternate to that of FIG. 1.

Referring to FIG. 26, a circular platform 120 may have in lower region 141 a number of bosses 141A and indentations 141B to form an interior, corrugated structure that prevent slipping of the flexible member 134, which may be formed with a mating surface having indentations 135A and bosses 135B to enhance this non-slip feature. The edge of platform 120 is formed by rotational molding or other means into a wall 124 that curls back to form a lip 125. The outside of peripheral curled wall 124 is essentially a section of a toroid. The inside of curled wall 124 is more complex and has an outwardly projecting, bulbous, annular cavity 126, and an axially projecting, bulbous, annular cavity 128. Wall 124 has annular hollow regions 124A and 124B. Cavities 126 and 128 are shaped to mate with annular bulbous projections 130 and 132 of flexible member 134.

Flexible member 134 has a domed portion 136 and a floor portion 135 that are integral with each other and meet along the periphery that includes projections 130 and 132. Flexible member 134 may also be formed by rotational molding.

Figure 27:
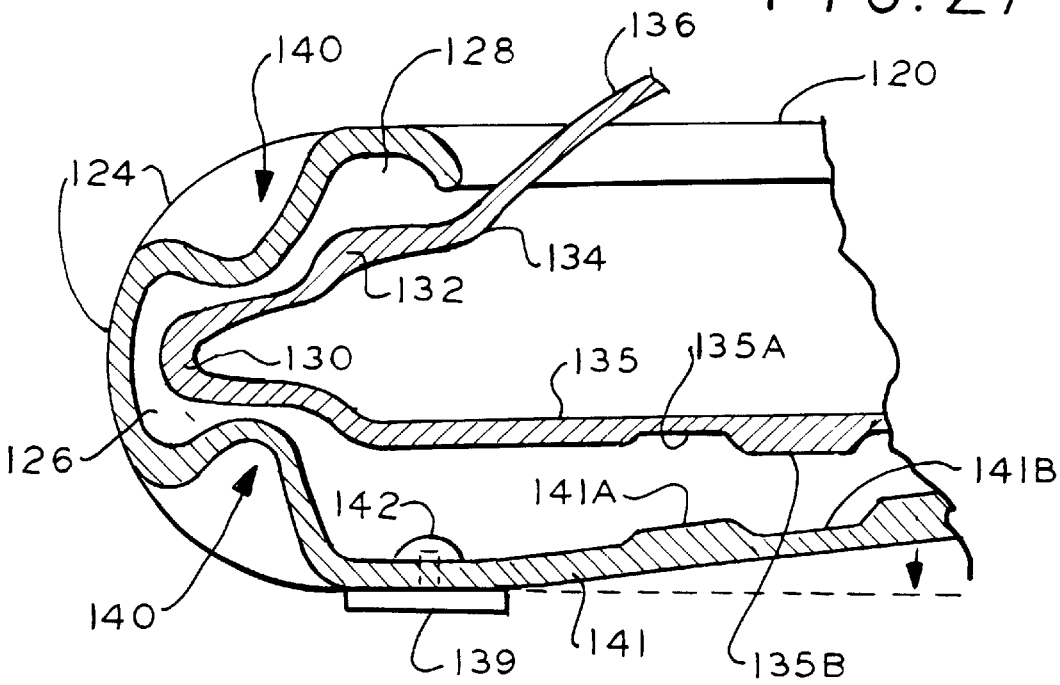
FIG. 27 is a cross-sectional view of the device of FIG. 26 taken at a circumferentially displaced position and with its flexible member deflated.

Referring to FIG. 27, flexible member 134 is shown deflated with its projections 130 and 132 released from cavities 126 and 128. Without the inflationary pressure, lower platform section 141 can return to its unstressed state, where it bows inward slightly. Platform section 141 also has a number of dimples 142 for receiving the shank of tack-like rubber feet 139.

FIG. 27 is taken at a different circumferential position where the previously mentioned hollows (hollows 124A and 124B) are open, thereby effectively providing handholds 140. In the preferred embodiment, four equiangularly spaced handholds are provided, although a different number may be employed in other embodiments. Also in the preferred embodiment, projection 130 may be notched to fit around inward projections (not shown) on the inside wall of cavity 126 in order to prevent flexible member 134 from rotating inside wall 124.

When flexible member 134 is inflated, projections 130 and 132 swell and fit into cavities 126 and 128. This effectively locks the edge of inflatable member 134 into the position shown in FIG. 26. Also, the inward bias of platform section 141 is overcome by the inflationary pressure, which pushes platform 141 from the position shown in full lines in FIG. 27 to the position shown in phantom (which latter position is also the position shown in full lines in FIG. 26).

To facilitate an understanding of the principles associated with the foregoing apparatus, the use of the device of FIG. 1 will be briefly described. The user will initially inflate the device by inserting a pump needle through valve means 14. The sheet-like member 12 will be inflated and will distend accordingly. With a modest level of inflation, sheet-like member 12 will take the hemispherical shape 12A shown in FIG. 2 when unloaded (that is, when suspended so that the sheet-like member 12 does not touch the ground).

Figure 7A:
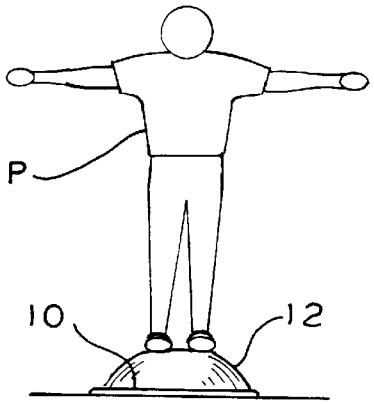
FIGS. 7A–7D show the device of FIG. 1 being used in a variety of exercises.

The foregoing device may be used with the platform 10 resting on the ground as shown in FIG. 7A. Here, a person P stands on sheet-like member 12, working to maintain balance. For an especially challenging session, a person can stand on one foot. The difficulty can be further increased if the person P rolls or tilts the head, with or without the eyes closed. Another, surprisingly challenging session can consist of simply kneeling on the sheet-like member 12. This effort can be reduced for a novice by getting down on all fours and then working to maintain balance.

The person P may mount sheet-like member 12 in order to receive various benefits. The user may perform an exercise in order to improve the user's sense of balance. In some cases, the user may suffer from a disability that affects coordination and balance. Therefore, the device can be used to improve motor skills and balance as a form of therapy, rehabilitation and prehab. In other cases, an athlete may wish to improve balance for any one of a number of sports requiring a refined sense of balance. Alternatively, the user may stand on member 12 simply to exercise his or her muscles. Of course, some users will stand on member 12 simply for enjoyment.

The amount of exercise sustained by mounting the device can be substantial. The person maintaining balance will normally be required to make many rapid and urgent posture adjustments by exerting a wide range of muscles. Moreover, this effort takes place with a sense of stimulation and excitement that makes the effort challenging and interesting. Thus, the user can quickly reach a high level of exertion without the usual sense of tedium or labor.

As the user's balance, coordination, and endurance improve, the user may wish to increase the level of difficulty. Accordingly, the pressure within the device can be decreased by venting valve means 14. This reduced pressure leads to less sure footing and increased effort to maintain balance. Alternatively, the pressure can be increased to accommodate an especially difficult routine, or to accommodate a user that is tired or less experienced. This increased pressure corresponds to more stability, since the sheet-like member 12 is less able to shift, distend, and distort underneath the user. An advantage with the foregoing pressure adjustment is that the user can continuously and finely adjust the pressure and the level of difficulty to suit his or her personal needs.

Because the device can be adjusted to become relatively stable, the user can readily perform ordinary exercises. For example, the user can squat, or stretch and stand on his or her toes as an exercise. Such exercises provide the dual benefit of conditioning muscles, while simultaneously training a person to maintain balance. Other exercises are contemplated, such as leg kicks, knee lifts, etc.

Figure 7B:
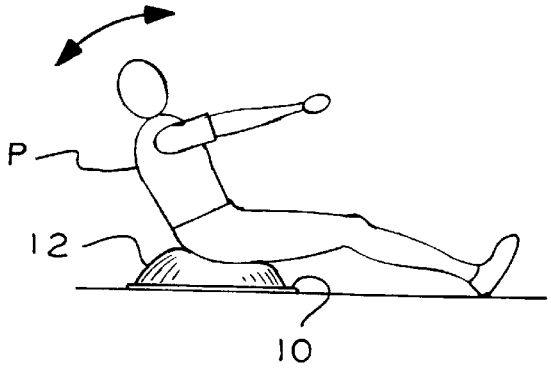

A person P can also sit on sheet-like member 12 as shown in FIG. 7B to perform abdominal exercises. Here, the user can decrease the level of difficulty by shifting forward to reduce the amount of upper body weight that is cantilevered out past the device. An additional advantage is that sheet-like member 12 can conform to the user's body and support the lower back as the user leans back. Decreasing the pressure within sheet-like member 12 can increase the amount of lower back support under such circumstances.

Figure 7C:
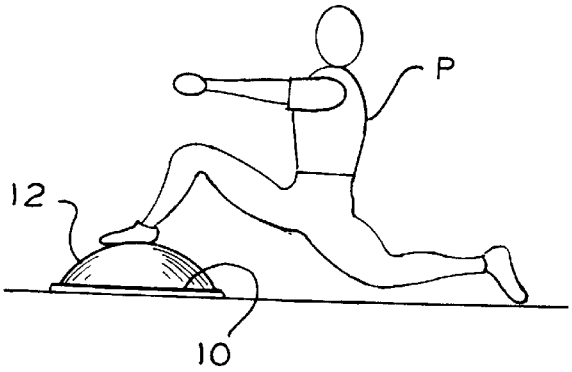

Various other exercises can be performed on the device, oriented platform down. As shown in FIG. 7C, person P can perform lunges. In fact, many of the exercises that are performed in step aerobics classes can be performed with the presently disclosed device. One advantage with this mode of use is that the exercise is very low impact, since sheet-like member 12 acts like a cushion. Again, the pressure behind sheet-like member 12 can be adjusted to change the level of difficulty. Also, the cushioning effect of sheet-like member 12 can make the exercises low impact, which is very important in step aerobics in order to avoid the joint injury that commonly occur with long-term use.

Figure 7D:
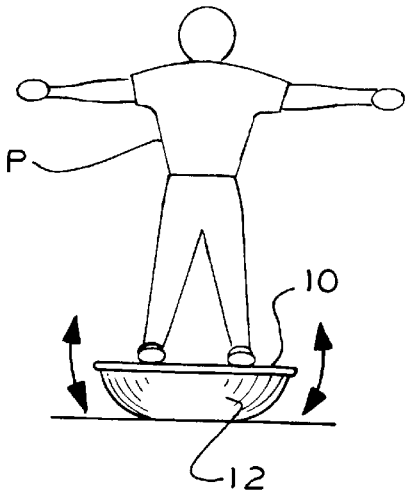

The foregoing device need not be used with the platform down, but may be oriented platform up, as shown in FIG. 7D. Because the device is inherently less stable when inverted as in FIG. 7D, the user will receive a more vigorous experience, which may be appropriate for athletic training.

When placed on the ground (level G1 of FIG. 2) in order to support a person as shown in FIG. 7D, sheet-like member 12 will become more squat and take the outline 12A shown in phantom in FIG. 2. This is a relatively more stable condition and the user can maintain balance while standing on platform 10 without too much difficulty.

Pressure can then be increased by reattaching a pump to valve means 14. Sheet-like member 12 may then be pressurized to distend further and take the outline 12B shown in phantom in FIG. 2, when placed on the ground at level G2. Outline 12B is closer to hemispherical and will make the platform 10 less stable. If the device is built sufficiently strong to sustain a very high pressure, sheet-like member 12 can distend to the almost precisely hemispherical shape shown in full line in FIG. 2. This represents the highest level of difficulty, requiring a high level of skill and endurance.

Obviously, many modifications and variations of the present invention are possible in light of the above teachings. It is therefore to be understood that within the scope of the appended claims, the invention may be practiced otherwise than as specifically described.

What is claimed is:

1. A device for physical therapy, conditioning or training, comprising:

a support platform;

a flexible member affixed to, and having a bowl-shaped distention projecting from one side of, said platform, said flexible member being inflatable to a pressure for supporting a person;

wherein said platform has a substantially circular border; and wherein said border of said platform is rolled in a direction away from the flexible member.

2. A device for physical therapy, conditioning or training, comprising:

a support platform;

a flexible member affixed to, and having a bowl-shaped distention projecting from one side of, said platform, said flexible member being inflatable to a pressure for supporting a person;

an element secured to said platform, said flexible member being sandwiched between said element and said platform; and wherein said element has an annular groove, the device comprising a cord positioned between said platform and said flexible member in alignment with said annular groove, so that said cord tends to press said flexible member into said annular groove.

3. A device for physical therapy, conditioning or training as claimed in claim 2 wherein said element has an annular furrow, the flexible member having an edge secured in said furrow.

4. A device for physical therapy, conditioning or training, comprising:

a support platform;

a flexible member affixed to, and having a bowl-shaped distention projecting from one side of, said platform, said flexible member being inflatable to a pressure for supporting a person; and an annular bead peripherally secured to said platform.

5. A device for physical therapy, conditioning or training as claimed in claim 4 wherein said flexible member is sandwiched between said bead and said platform.

6. A device for physical therapy, conditioning or training as claimed in claim 5 wherein said platform has an inside and an outside face, said bead being attached upon said outside face of said platform.

7. A device for physical therapy, conditioning or training as claimed in claim 4 wherein said flexible member comprises a domed portion and a substantially flat portion encompassing a closed volume.

8. A device for physical therapy, conditioning or training as claimed in claim 7 wherein said flexible member comprises an annular foot peripherally connected to said domed portion and said substantially flat portion, said annular bead being attached to said platform to engage and hold said foot.

9. A device for physical therapy, conditioning or training as claimed in claim 8 wherein said foot has a heel directed radially inward, said platform having a flange adapted to engage and hold said heel.

10. A device for physical therapy, conditioning or training as claimed in claim 8 wherein said foot has a toe directed radially outward, said annular bead being adapted to engage and hold said toe.

11. A device for physical therapy, conditioning or training as claimed in claim 10 wherein said toe has a valley, said annular bead having an annular ridge adapted to fit into said valley.

12. A device for physical therapy, conditioning or training as claimed in claim 10 wherein said annular bead has a C-Shaped cross-section with a pair of branches adapted to straddle said platform.

13. A device for physical therapy, conditioning or training as claimed in claim 12 wherein said platform has a peripheral undercut channel, one of said branches of said bead being graded to fit under said undercut channel of said platform.

14. A device for physical therapy, conditioning or training as claimed in claim 4 wherein said annular bead is joined to said platform with a tongue and groove joint.

15. A device for physical therapy, conditioning or training as claimed in claim 4 wherein said annular bead is joined to said platform with a snap joint.

16. A device for physical therapy, conditioning or training as claimed in claim 4 wherein said annular bead is closed into a loop at at least one circumferential joint.

17. A device for physical therapy, conditioning or training as claimed in claim 11 wherein said annular bead has a J-shaped cross-section attached to said platform and shaped to hook onto said toe of said foot.

18. A device for physical therapy, conditioning or training, comprising:

a support platform;

a flexible member affixed to, and having a bowl-shaped distention projecting from one side of, said platform, said flexible member being inflatable to a pressure for supporting a person; and wherein said flexible member comprises a plurality of domes attached to one side of said platform.

19. A device for physical therapy, conditioning or training, comprising:

a support platform;

a flexible member affixed to, and having a bowl-shaped distention projecting from one side of, said platform, said flexible member being inflatable to a pressure for supporting a person;

wherein said platform has a peripheral curled wall arranged to peripherally engage said flexible member;

wherein said flexible member comprises a domed portion and a substantially flat portion encompassing a closed volume; and wherein said curled wall has a plurality of concave handholds.

20. A device for physical therapy, conditioning or training, comprising:

a support platform;

a flexible member affixed to, and having a bowl-shaped distention projecting from one side of, said platform, said flexible member being inflatable to a pressure for supporting a person;

wherein said platform has a peripheral curled wall arranged to peripherally engage said flexible member;

wherein said flexible member comprises a domed portion and a substantially flat portion encompassing a closed volume; and wherein said platform tends to bow inwardly but deform into a flat configuration when said flexible member is inflated.

21. A device for physical therapy, conditioning or training, comprising:

a support platform having a first side and a second side, the second side of the platform structured and arranged for stable resting on the ground;

an inflatable, flexible member affixed to and extending upwards over the first side of the platform, said flexible member being substantially hemispherical when affixed to the platform and inflated;

a clamp clamping the flexible member in between the clamp and support platform to affix the flexible member to the platform such that the flexible member extends upwards over the first side; and wherein said platform has at least one cavity sized to provide a handhold.

22. A device for physical therapy, conditioning or training, comprising a support platform having two sides, one side of the platform structured and arranged for stable resting on the ground;

a flexible member affixed to, and having a bowl-shaped distention projecting from the other side of, said platform, said flexible member being inflatable to a pressure for supporting a person and being substantially hemispherical before bearing a load;

an annular bead peripherally secured to said platform; and wherein said platform has at least one cavity sized to provide a handhold.

23. A device for physical therapy, conditioning or training, comprising:

a support platform having a first side and a second side, the second side of the platform structured and arranged for stable resting on the ground;

an inflatable, flexible member affixed to and extending upwards over the first side of the platform, said flexible member being substantially hemispherical when affixed to the platform and inflated;

a clamp clamping the flexible member in between the clamp and support platform to affix the flexible member to the platform such that the flexible member extends upwards over the first side; and wherein said flexible member comprises a substantially hemispherical portion and a substantially flat portion encompassing a closed volume.

24. A device for physical therapy, conditioning or training, comprising:

a support platform having two sides, one side of the platform structured and arranged for stable resting on the ground;

a flexible member affixed to, and having a bowl-shaped distention projecting from the other side of, said platform, said flexible member being inflatable to a pressure for supporting a person and being substantially hemispherical before bearing a load;

an annular bead peripherally secured to said platform; and wherein said flexible member comprises a substantially hemispherical portion and a substantially flat portion encompassing a closed volume.

25. A device for physical therapy, conditioning or training as claimed in claim 23 wherein said flexible member comprises an annular foot peripherally connected to said substantially hemispherical portion and said substantially flat portion, said annular bead being attached to said platform to engage and hold said foot.

26. A device for physical therapy, conditioning or training as claimed in claim 24 wherein said flexible member comprises an annular foot peripherally connected to said substantially hemispherical portion and said substantially flat portion, said annular bead being attached to said platform to engage and hold said foot.

27. A device for physical therapy, conditioning or training, comprising:

a support platform;

an annular bead peripherally secured to said platform;

a flexible member affixed to, and having a bowl-shaped distention projecting from one side of, said platform, said flexible member being sandwiched between said bead and said platform and being inflatable to a pressure for supporting a person; and wherein said flexible member comprises a bowl-shaped portion and a substantially flat portion encompassing a closed volume.

28. A device for physical therapy, conditioning or training as claimed in claim 27 wherein said flexible member comprises an annular foot peripherally connected to said bowl-shaped portion and said substantially flat portion, said annular bead being attached to said platform to engage and hold said foot;

wherein said foot has a toe directed radially outward, said annular bead being adapted to engage and hold said toe; and wherein said annular bead has a C-shaped cross-section with a pair of branches adapted to straddle said platform.

29. A device for physical therapy, conditioning or training as claimed in claim 27 wherein said flexible member comprises an annular foot peripherally connected to said bowl-shaped portion and said substantially flat portion, said annular bead being attached to said platform to engage and hold said foot;

wherein said foot has a toe directed radially outward, said annular bead being adapted to engage and hold said toe; and wherein said annular bead has a J-shaped cross-section attached to said platform and shaped to hook onto said toe of said foot.

30. A device for physical therapy, conditioning or training, comprising:

a support platform having a first side and a second side, the second side of the platform structured and arranged for stable resting on the ground;

an inflatable, flexible member affixed to and extending upwards over the first side of the platform, said flexible member being substantially hemispherical when affixed to the platform and inflated;

a clamp clamping the flexible member in between the clamp and support platform to affix the flexible member to the platform such that the flexible member extends upwards over the first side; and wherein said platform tends to bow inwardly but deform into a flat configuration when said flexible member is inflated.

31. A device for physical therapy, conditioning or training, comprising:

a support platform having two sides, one side of the platform structured and arranged for stable resting on the ground;

a flexible member affixed to, and having a bowl-shaped distention projecting from the other side of, said platform, said flexible member being inflatable to a pressure for supporting a person and being substantially hemispherical before bearing a load;

an annular bead peripherally secured to said platform; and wherein said platform tends to bow inwardly but deform into a flat configuration when said flexible member is inflated.

* * * * *

UNITED STATES PATENT AND TRADEMARK OFFICE

CERTIFICATE OF CORRECTION

PATENT NO. : 6,575,885 B1
DATED : June 10, 2003
INVENTOR(S) : David Weck

It is certified that error appears in the above-identified patent and that said Letters Patent is hereby corrected as shown below:

Column 2,
Line 29, “provided, a” should read -- provided a --

Column 7,
Line 29, “361” should read -- 36I --

Column 8,
Line 16, “such shelf” should read -- such as shelf --

Signed and Sealed this

Seventh Day of October, 2003

JAMES E. ROGAN
*Director of the United States Patent and Trademark Office*